United States Patent [19]

Buffo

[11] Patent Number: 5,010,813

[45] Date of Patent: Apr. 30, 1991

[54] MULTICOLOR FLEXOGRAPHIC MACHINE WITH A DEVICE FOR AUTOMATICALLY LOADING AND UNLOADING BLOCK-HOLDING ROLLERS

[75] Inventor: Flavio Buffo, Villafranca, Italy

[73] Assignee: Uteco S.p.A. Flexo & Converting Machinery, San Martino Buon Albergo, Italy

[21] Appl. No.: 529,426

[22] Filed: May 29, 1990

[30] Foreign Application Priority Data

Jun. 2, 1989 [IT] Italy ..... 84940 A/89

[51] Int. Cl.[5] ..... B41F 5/24; B41F 13/00

[52] U.S. Cl. ..... 101/178; 101/216; 414/911

[58] Field of Search ..... 101/178, 219, 216, 217; 414/911, 225

[56] References Cited

U.S. PATENT DOCUMENTS

| | | | |
|---|---|---|---|
| 3,789,757 | 2/1974 | Motter et al. | 101/216 X |
| 3,876,087 | 4/1975 | Osta | 101/216 X |
| 4,137,843 | 2/1979 | Ottenhue | 101/216 X |
| 4,586,434 | 5/1986 | Tokuno et al. | 101/178 |
| 4,932,827 | 6/1990 | Schlunke et al. | 414/911 X |

FOREIGN PATENT DOCUMENTS

| | | | |
|---|---|---|---|
| 2485990 | 1/1982 | France | 101/178 |

*Primary Examiner*—Clifford D. Crowder

*Attorney, Agent, or Firm*—Guido Modiano; Albert Josif

[57] ABSTRACT

Multicolor flexographic machine comprising a plurality of printing units, a robot in close relationship with the printing units and arranged to remove in succession each block-holding roller from its working position on the flexographic machine, to place it on a roller support trolley and to replace it with another block-holding roller available on the roller support trolley. A system for presetting the block-holding rollers is provided to obtain correct printing overlap in the machine and is controlled by an actuation unit which governs a contact-separation sequence of the rollers in each printing unit with micrometric adjustment of the roller pressure. Each block-holding roller is held in position free to rotate by automatically opening and closing holding caps.

14 Claims, 10 Drawing Sheets

MULTICOLOR FLEXOGRAPHIC MACHINE WITH A DEVICE FOR AUTOMATICALLY LOADING AND UNLOADING BLOCK-HOLDING ROLLERS

BACKGROUND OF THE INVENTION

Multicolor flexographic machine for continuous printing on a tape, such as a plastic film or a paper web, having an automatic system for replacing the block-holding printing rollers.

As is known, two or more (up to eight) printing units are provided in multicolor flexographic machines currently in use. Each printing unit is arranged angularly spaced adjacent to an offset roller and is constituted by a block-holding roller, a screen roller and a drawing roller or by a doctor blade.

The operation of replacing the block-holding rollers is performed manually by two operators who come aside the machine with a hoist and disconnect and unload the rollers used in a previous printing operation on a suitable supporting trolley and replacing them with new block-holding rollers.

The entire operation is predominantly manual and thus it entails a rather long downtime during which the machine remains inactive, which negatively affects its productivity.

As a matter of fact this operation also comprises, besides removing of the printing units and replacement of the block-holding rollers, a series of manual preparatory setting up operations, such as release and locking of the retention means for the block-holding rollers, presetting of the replaced rollers to make sure that their angular position with respect to the offset roller is such as to obtain a correct overlay of the various colors on the printing material.

Handling and movement of the block-holding rollers at the various printing units of a flexographic machine are also made difficult owing to the narrow spaces available between one printing unit and the other.

Said operations must therefore be necessarily performed by highly qualified and trained personnel, which results in high operating costs.

SUMMARY OF THE INVENTION

The main object of the present invention is to provide a multicolor flexographic machine in which mounting and dechucking of the block-holding rollers occurs substantially automatically, so as to have minimum downtimes and consequently a very high productivity.

Another object of the present invention is also to automate the setup operations, also termed operations for presetting the block-holding rollers, so as to achieve precise overlay of the various colors in the machine.

Another object of the present invention is to increase safety for the personnel operating a flexographic machine, since in general no manual operation is required near the work area of said machine.

A further object is that the said flexographic machine has, in a position easily accessible by an operator, means for a fine or micrometric adjustment of the distance between each block-holding roller and the offset roller.

Another important object of the present flexographic machine is to achieve high operating reliability so as to reduce the number of stops for breakdown or maintenance.

These and other objects which will become better apparent hereinafter are achieved by a multicolor flexographic machine with star-shaped structure, having two supporting shoulders, an offset roller or drum mounted for rotation on said shoulders, a plurality of inking stations arranged angularly spaced around the offset roller, each station comprising a block-holding roller adjacent to the offset roller and a screen roller which is arranged to transfer ink from a drawing cylinder or from a doctor blade to the block-holding roller and can be moved close to, or away from, the offset roller, characterized in that it comprises a device or robot for automatic sequential loading and unloading of the block-holding rollers on and from the various inking stations, said device having a support saddle or carriage which is motor-driven along guides which extend parallel to a shoulder of the machine, an upright structure which extends from the support and is mounted for rotation about a vertical axis, a retractable arm which projects from said upright structure, grip means supported by said arm and adapted to engage an end or hold of a block-holding roller to raise it in a cantilevered manner, actuating means on said arm which are adapted to cause said arm to retract or extend, and program control means for controlling said loading and unloading device.

BRIEF DESCRIPTION OF THE DRAWINGS

Further aspects and advantages of the invention will become better apparent from the description of a preferred but not exclusive embodiment of a multicolor flexographic machine, illustrated by way of non-limitative example in the accompanying drawings, wherein.

DESCRIPTION OF THE PREFERRED EMBODIMENTS

Figure 1:
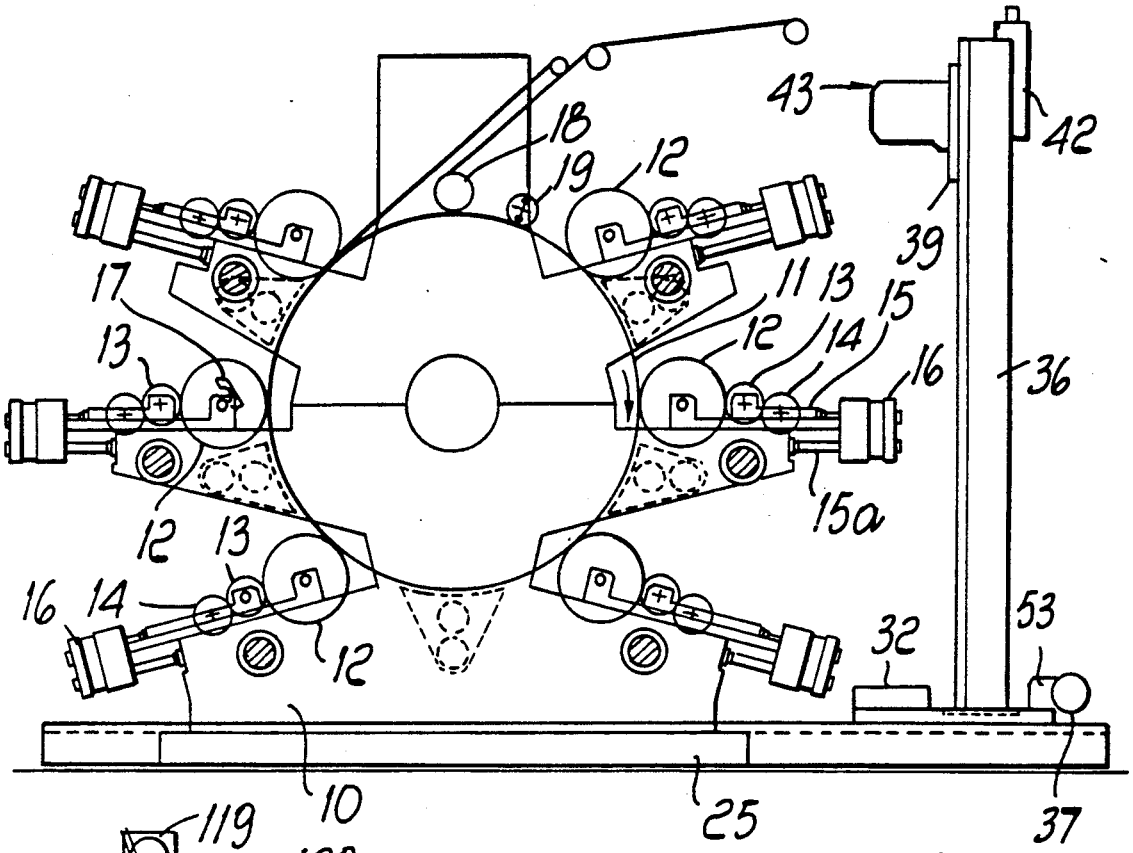
FIG. 1 is a partial and schematic side view of a multicolor flexographic machine having an offset roller and six inking stations.
Figure 2:
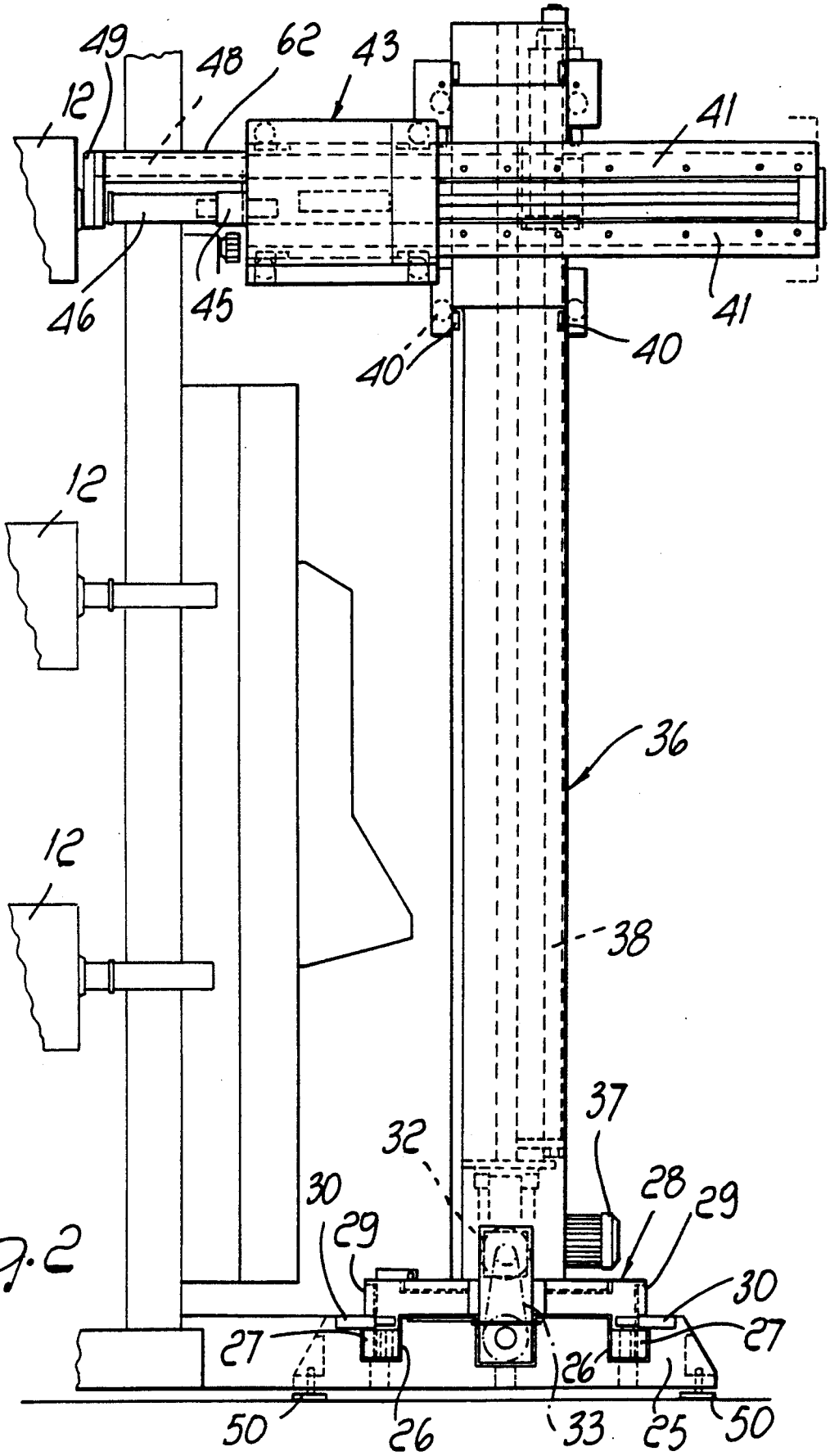
FIG. 2 is a side view of a device for automatic loading and unloading block-holding rollers, which also illustrates part of a block-holding roller which is engaged in a cantilevered manner by said automatic device.
Figure 3:
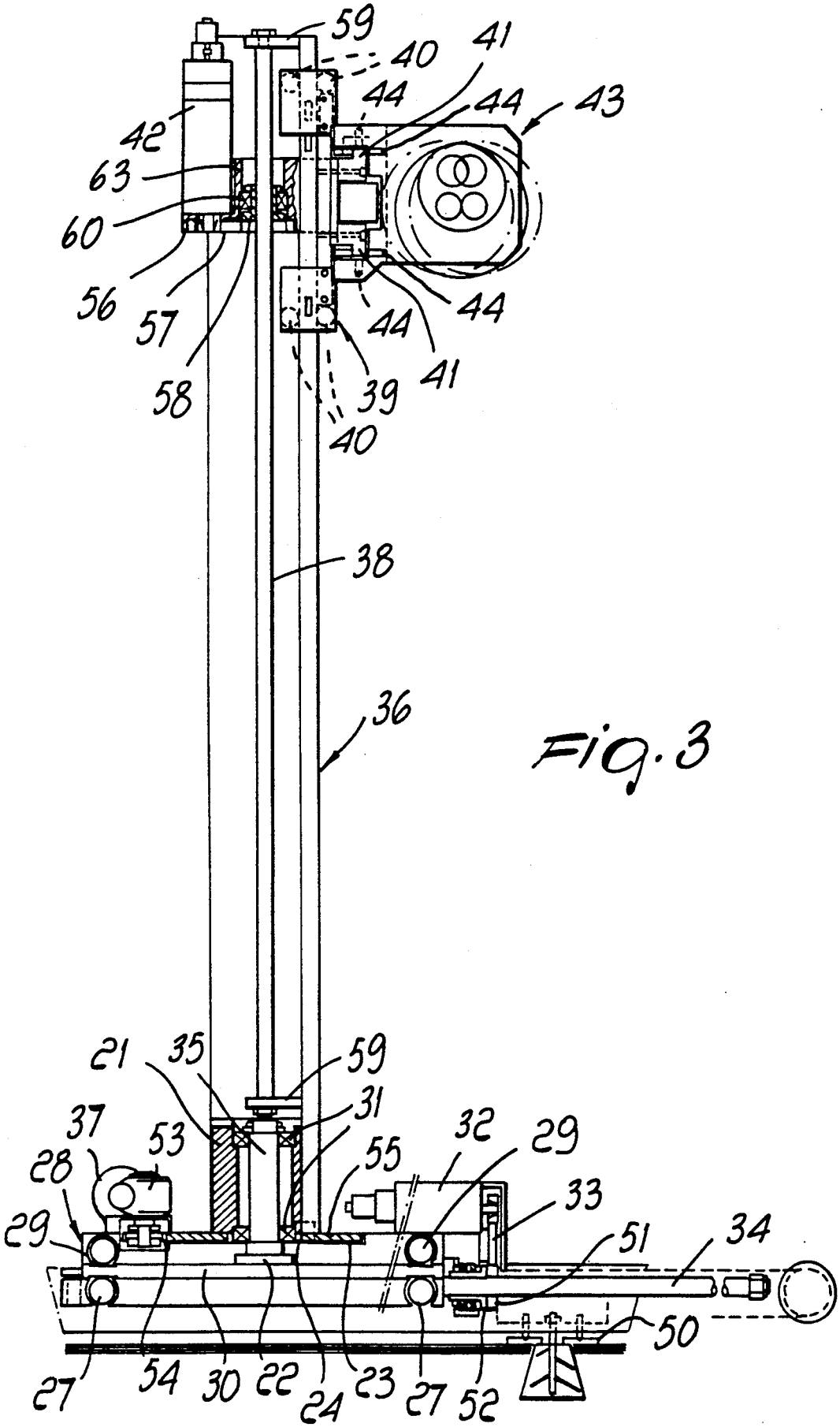
FIG. 3 is a front partly sectioned view of the device of FIG. 2.

With reference to the above described FIGS. 1, 2 and 3, two substantially star-shaped lateral shoulders 10 support a central offset roller 11 which is in contact with a plurality of angularly spaced block-holding rollers 12, each of which is in contact with a respective screen cylinder 13 which is in turn tangent to a drawing cylinder 14.

Two feeding screws 15, 15*a* extend from the side shoulders 10 at each inking station comprising a cylinder 12, 13 and 14, and reach a respective actuation unit 16.

A holding cap 17 is shown at the end of each block-holding roller and is pivoted so that it can be rotated to an opened position and to a closed position.

Transmission and pressure rollers are provided in the upper part of the machine, e.g. one of said rollers 18 is arranged at the top of the drum 11, another 19 is angularly spaced from the roller 18 and upstream of the block-holding roller 12.

A slide base 25 extends along one shoulder 10 of the machine and is fixed to the ground, e.g. by means of plates 50, and is provided with parallel and longitudinal guiding grooves or runways 26 arranged to guide lower wheels 27 of a carriage 28 arranged on said base. The carriage 28 is also provided with upper wheels 29 adapted to roll on a respective gib 30 arranged parallel and adjacent to a respective guiding groove or recess, above which it protrudes. The carriage 28 is actuated by an electric motor 32 through a belt 33 which passes around a pulley 51 rigidly keyed on a lead nut 52 in which a screw 34 mounted for rotation on balls is engaged.

The carriage 28 is provided with a recess 23 on its loading platform in which a center plate 55 having a large central bore 24 is mounted for rotation.

An upright 36 rests on, and is secured to, said center plate 55. The upright 36 can be T-shaped in cross section and has a wing bolted to a stem which can rotate about a vertical pivot pin 35, whose resting base 22 is fixed to the platform of the carriage 28 which is arranged below said center plate 55.

A tubular support 21 for the upright 36 is arranged about the pivot 35 in spaced relationship from it by means of bearings 31, and is fixed (e.g. bolted) to the upright 36 at its upper end and to the center plate 55 at its lower end, so that the upright 36 is rigid in rotation with the center plate 55.

A motor 37 mounted on the carriage 28 is operatively connected to a reduction unit 53 which transmits its motion to the center plate 55 by means of a gear 54.

A saddle or carriage 39 provided with a plurality of wheels 40 is slidably mounted along the upright 36 and is guided by the wing of the T-shaped structural element and controlled by a vertical screw 38 supported at its ends by supports 59 which are rigid with the upright 36.

The said carriage 39 is actuated by an electric motor 42 which is operatively connected thereto by means of a train of transmission gears 56 and 57 and a lead nut 58 in which the screw 38 is threaded. A bearing 60 is provided between the lead nut 58 and a sleeve 63 rigid with the carriage 39, said bearing being axially aligned with the lead nut and the screw 38.

Two guides 41, e.g. L-shaped guides, are fixed horizontally cantilevered on the carriage 39. A head or arm 43 can slide on said guides by means of roller bearings 44 and is actuated by a fluid-operated unit 61 arranged between said guides 41 and preferably comprising a cylinder and stemless piston unit, e.g. of a kind known per se in the art.

The head 43 is provided, at one end thereof, with a hollow cylinder 62 inside which a pivot 48 is accommodated and designed to actuate clamping jaws 49 in synchronization with the hollow cylinder or tube 62.

An engagement means, for example a pivot 45 which is partly insertable in a front recess provided in a hold 46 of each block-holding roller 12, is arranged below said hollow cylinder 62 and supported by the head 43.

Figure 4:
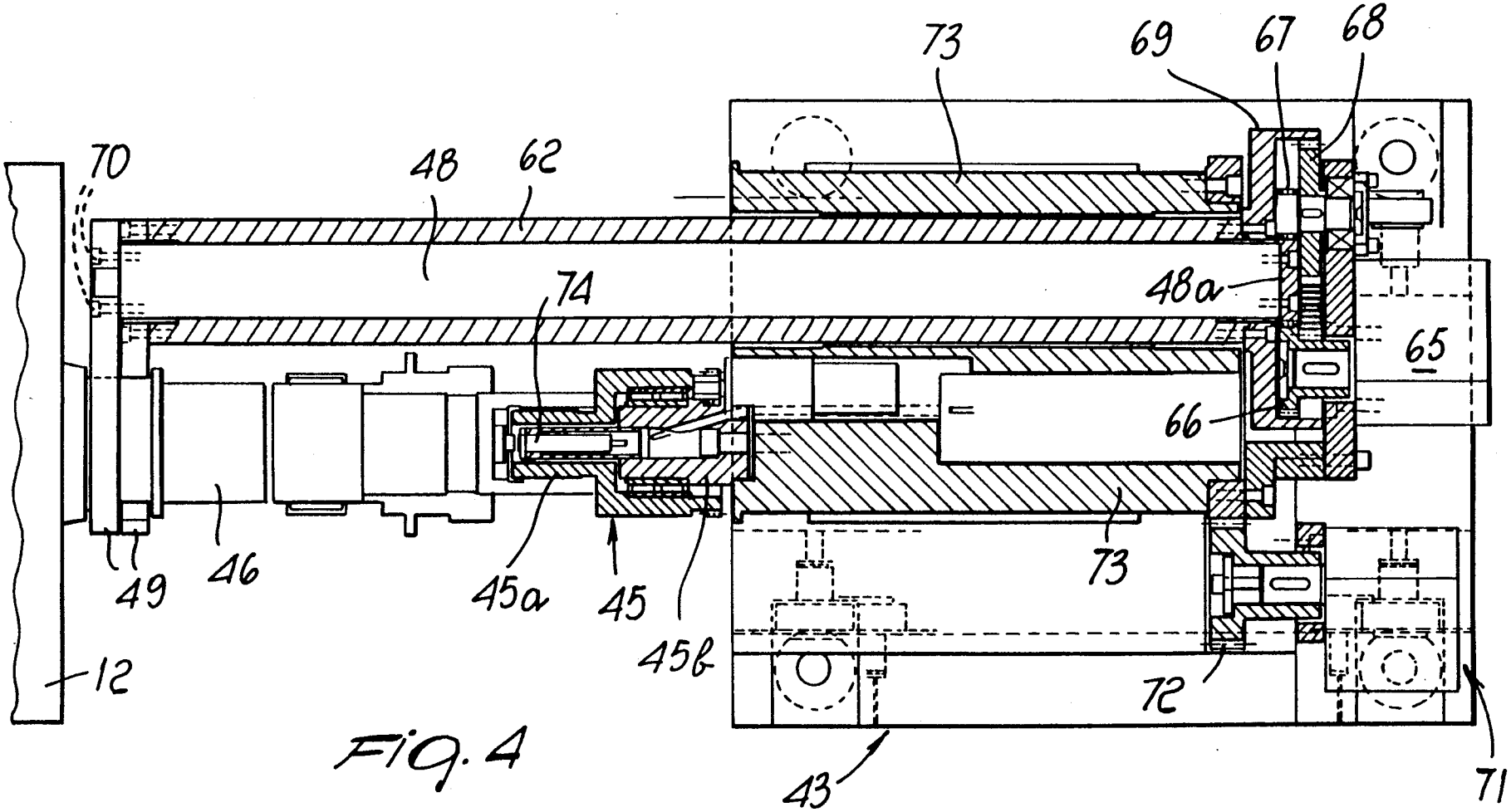
FIG. 4 is a cutout view of a portion of the device of FIG. 2 illustrating a sliding head of said device and arms for engaging and coupling a block-holding roller.
Figure 5:
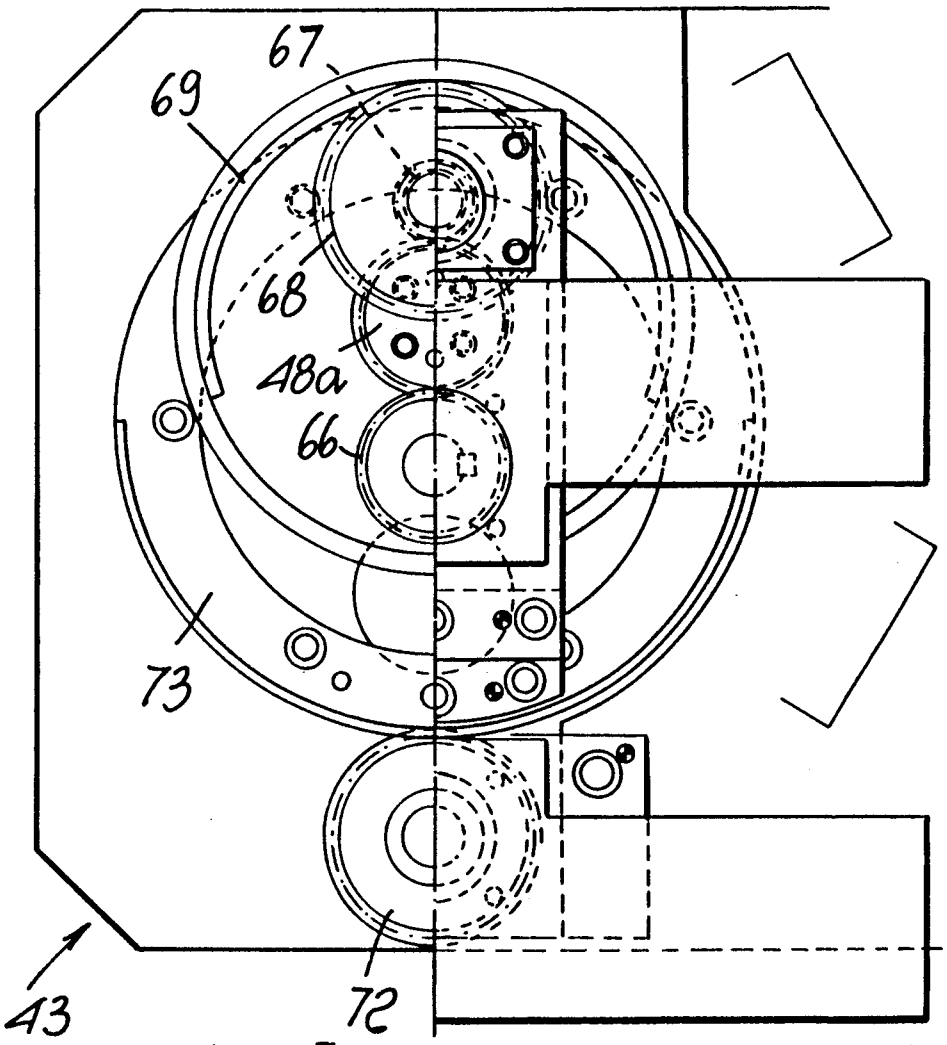
FIG. 5 is a cutout view of said sliding head for the various actuation mechanisms of the coupling arms.

More specifically with reference to FIGS. 4 and 5, a fluid-operated unit 65 provided with a sprocket 66 transmits the motion directly to the pivot 48 by means of a gear 48*a*. Said gear meshes with a transmission pinion 67 which has the same axis of rotation as a crown 68 which is in meshing engagement with an internal set of teeth of a cup gear 69 fixed to the hollow cylinder or tube 62 which is in turn mounted for rotation about the pivot 48. It will be noted that owing to the above described motion transmission the pivot 48 is rotated in the opposite direction of, but at the same angular speed as, the tube 62.

Respective locking clamps 49 are fixed, e.g. by means of stud bolts 70, to the opposite end of the tube 62 and the pivot 48. When in closed position, the said clamps fit, in an offset position, around the hold 46 of the block-holding roller 12.

A further fluid-operated unit 71 (whose function will be explained hereinafter and on which a sprocket 72 is mounted) transmits its motion to a general control sleeve 73 which is arranged around a portion of the hollow cylinder 62 and an engagement unit 45 which extends parallel to the hollow cylinder 62 and whose end can be partly inserted in the hold 46 of a block-holding roller.

The unit 45 can comprise for example a hollow pivot and a proximity detector 74 arranged inside the free or distal end of the pivot. As illustrated in FIG. 4, the hollow pivot 45 may also include a narrow tip 45*a* in which the proximity detector 74 is located. The proximity detector 74 is mounted on an inner support 45*b* extending parallel and adjacent to, and is mounted for rotation with respect to, the sleeve 73. If required, the tip 45*a* can be rotated by means of suitable motor means, such as an electric motor, not shown.

Figure 6:
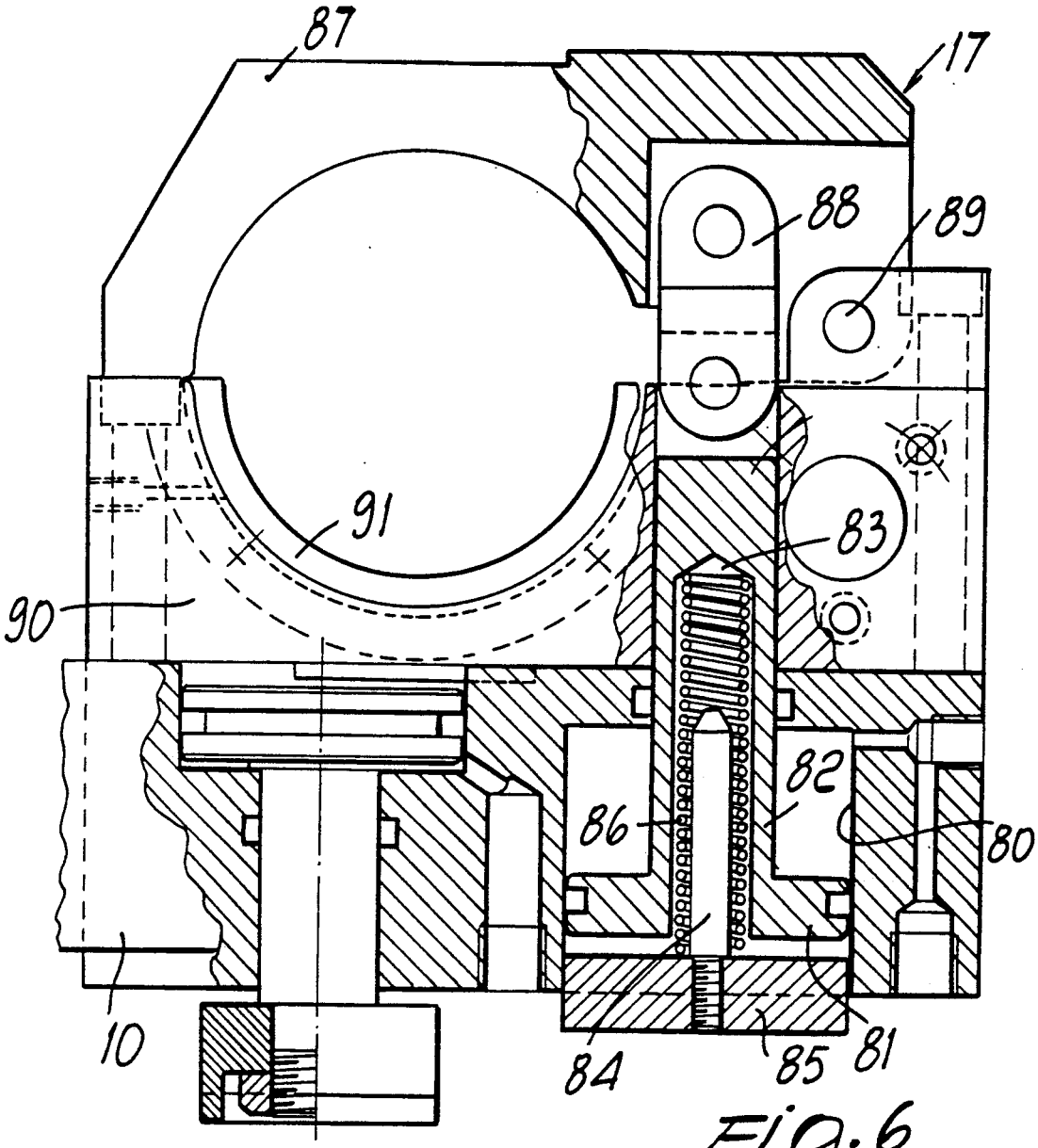
FIG. 6 is a sectional side view of a device for the automatic opening and closing of holding caps for a block-holding roller.

As illustrated in greater detail in FIG. 6, each holding cap 17 comprises an upper curved component 87 which has one end pivoted on a horizontal pivot 89 and its other end abuting on a cradle 90 which is supported by a shoulder 10 of the flexographic machine.

The cradle 90 and the upper component 87 have a respective recess for accommodating and retaining a suitable roller bearing 46*a* (FIG. 12) provided on the hold of each block-holding roller, the said bearing being carried by half a bush 91 supported by the cradle 90.

The upper structure 87 can be raised, lowered and locked in its closed position by means of any suitable actuation device, e.g. a fluid-operated device comprising a cylinder 80 designed to receive a working fluid, e.g. air or oil, which acts on a piston 81 slidably mounted in the cylinder and rigid with a stem 82.

A dead hole 83 is provided along the unit defined by the stem 82 and the piston 81. A pin 84 has one end located in the hole 83 and its other end secured to a support 85 which is in turn fixed to the inner wall of the cylinder 80. A spring 86 is coiled in a spiral on the pin 84 and reacts against the bottom of the dead hole 83.

The stem 82 is externally articulated to the upper component 87 by means of a connecting rod 88.

Figure 7:
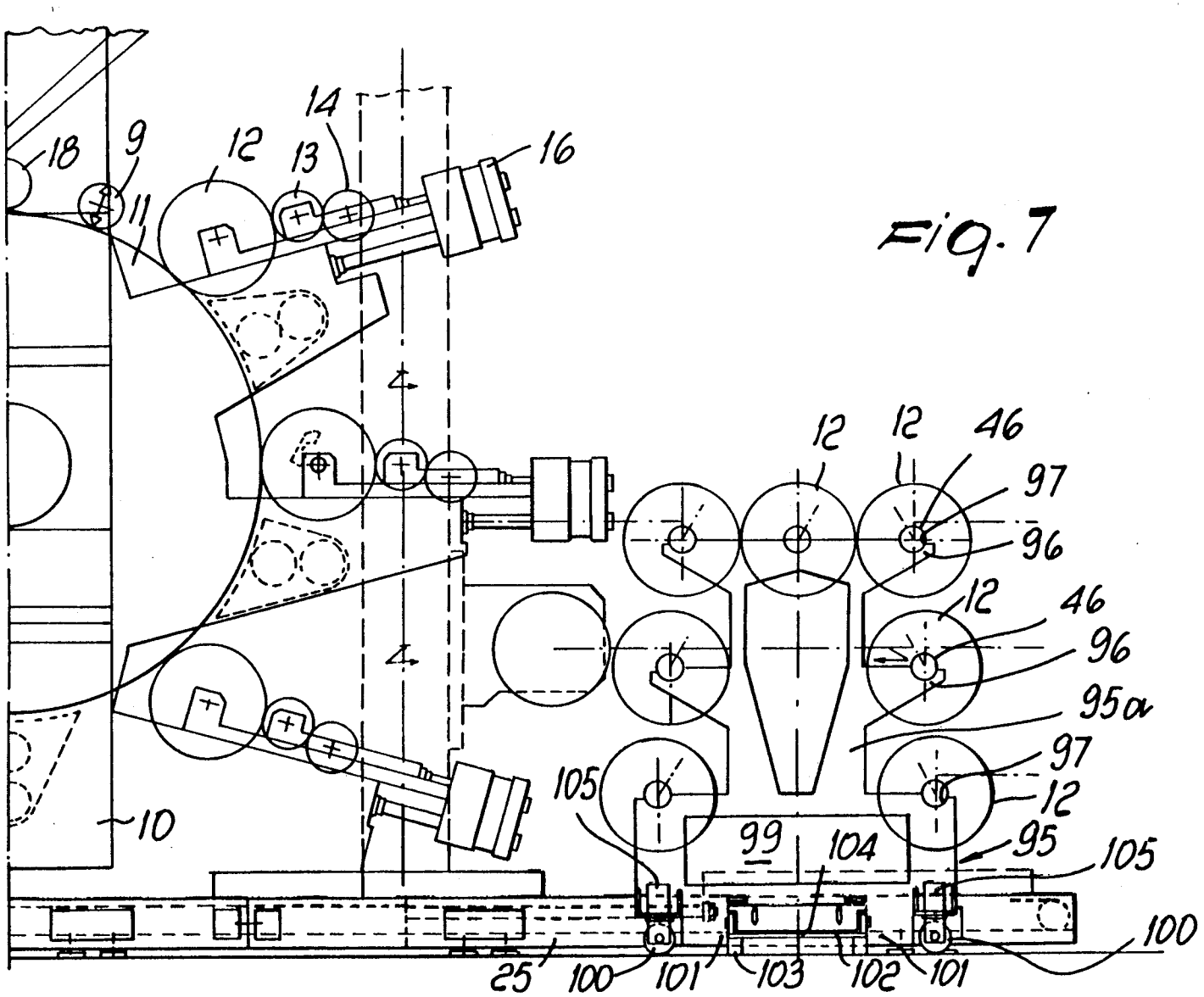
FIG. 7 is a side view of a roller supporting trolley loaded with block-holding rollers.

In FIG. 7 one of the two side shoulders 95*a*, which support the block-holding rollers of a roller supporting trolley 95, is illustrated.

The shoulders 95*a* are mutually joined at their bottom by a longitudinal crosspiece 99, rest on orientatable wheels 100 and have six protrusions 96 formed with seats 97 in which a hold 46 of a block-holding roller 12 can be received.

One of the seats 97 is generally empty.

In its lower portion, the trolley 95 has coupling means for engagement with fixed abutment means, such as for example pins 101 arranged to engage with recesses provided in the longitudinal base 25 so as to removably block the roller supporting trolley in a fixed and precisely determined position with respect to the roller loading and unloading device.

A gib 102, fixed to the ground in a predetermined position with respect to said automatic loading and unloading device, has a lateral widening 103 and a horizontal widening 104 to facilitate the engagement operation of the trolley and keep it slightly raised so that it is prevented from moving during loading or unloading operations on and from the trolleys.

Wheels 105 are adjustably fixed to the crosspiece 99 to obtain smooth sliding of the trolley on the gib 102.

Figure 8:
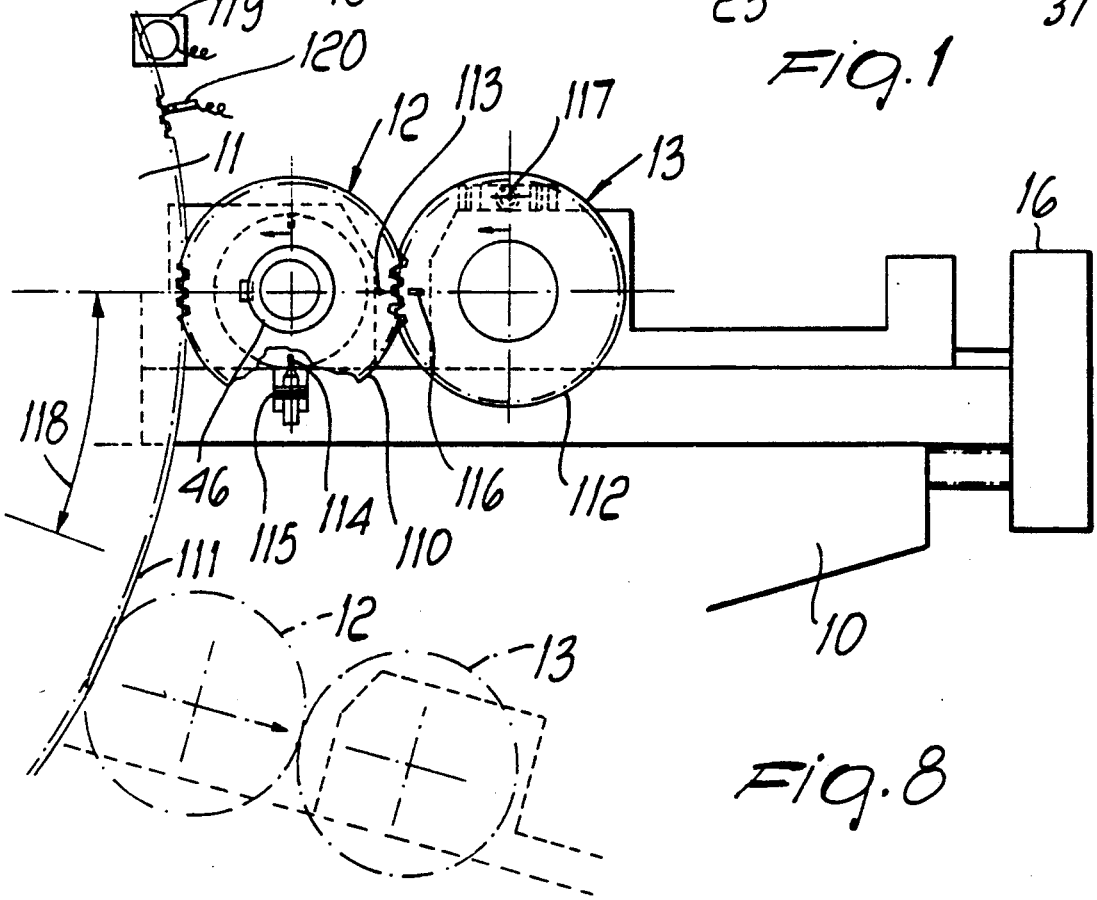
FIG. 8 is a partial and schematic side view of an inking station showing the gears of the offset roller, the block-holding roller and the screen roller.

Once a block-holding roller 12 has been placed on a printing unit, as will be further described hereinafter, it is necessary to perform a series of presetting and micrometric adjustment operations of the printing position and of the contact-separation position of the rollers, which can be done by acting on the units illustrated in FIGS. 8 and 9.

A gear 110, which is keyed on the hold of a block-holding roller 12, is in meshing engagement in a fixed reference position both with a lateral gear 111 rigid in rotation with the offset roller 11 and with a gear 112 of the screen roller 13.

The gear 110 is provided with a reference mark 113 exactly at ninety degrees with respect to a spring-loaded dowel 114 which is provided with a spring 115 and can be remote controlled, e.g. by a fluid-operated system (not shown).

The reference mark 113 is located at a cavity (between two teeth) of said gear 110, inside which a tooth of the gear 112, marked by a reference 116, must be arranged.

The reference mark 116 is at ninety degrees with respect to a dowel 117 which can be remote controlled, e.g. by a fluid-operated system (not shown).

The locked position reached by dowels 115 and 117 is detected by sensing means, e.g. by proximity devices (not shown).

The angular excursion 118 of the offset roller 11 corresponds to the extension of a block located on the block-holding roller 12 and is related to said offset roller.

Said angular excursion is measured by being converted into electric impulses by a coding device 119 arranged near to said gear 111, next to which there is provided a pulse detecting device 120.

Figure 9:
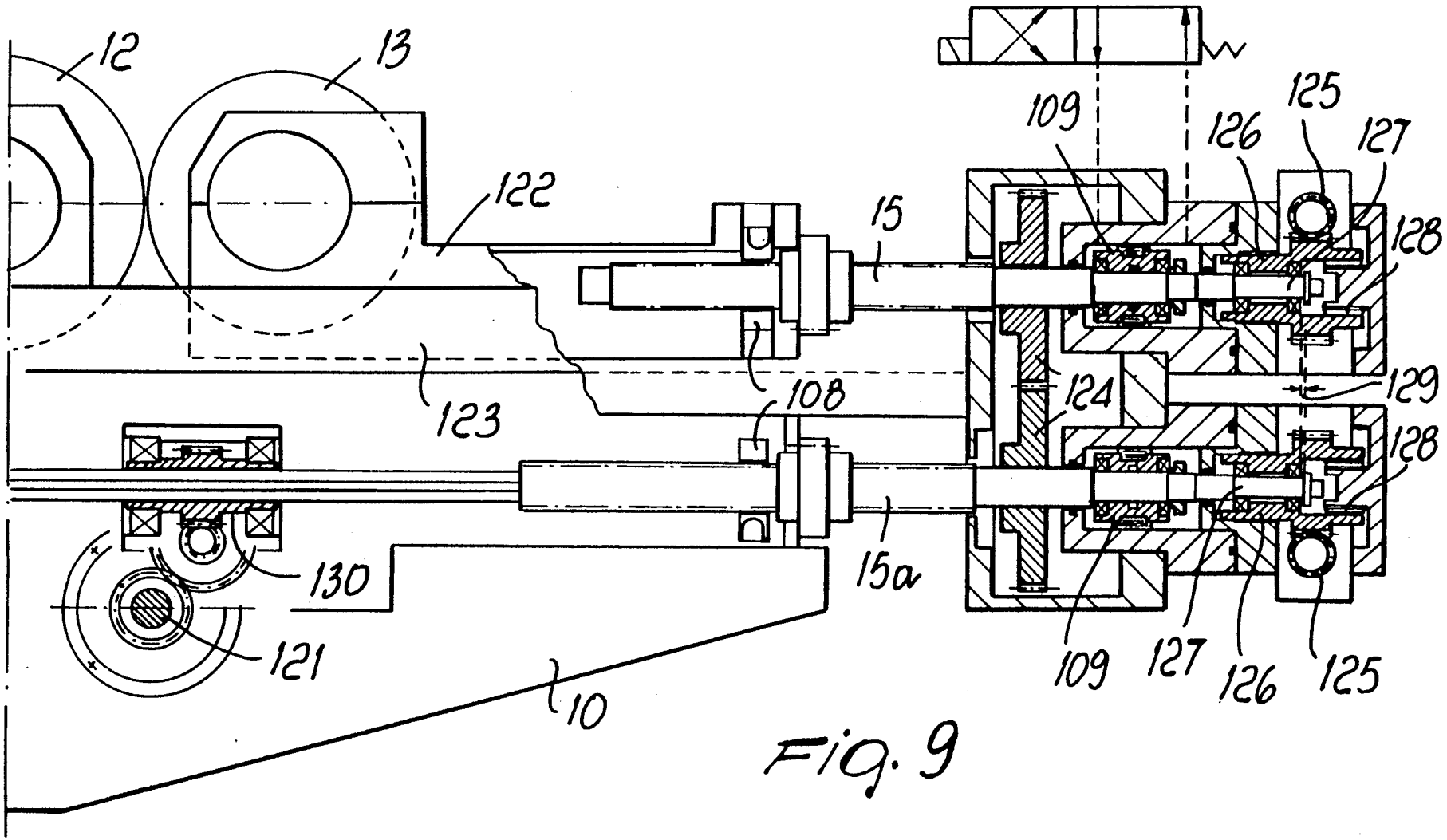
FIG. 9 shows the same view as FIG. 8, illustrating a sectional view of the unit for micrometric adjustment of the printing position.

Micrometric adjustment, after presetting, is performed by means of a print position registration unit arranged inside the actuation unit 16 (FIG. 9).

A gear 125, which can be operated by means of a handwheel (not illustrated) arranged outside the unit 16, acts on a pinion 126 which transmits its motion to a pivot 127 which is operatively connected to two feeding screws 15, 15*a* which move the block-holding roller 12 in contact with the offset roller.

The pivot 127 has a mechanical limit switch 128 which, together with the pinion 126, delimits a detatching stroke 129.

Positioning for printing is carried out by one motor (not illustrated in FIG. 9) which, through a rod 121 connecting one shoulder of the flexographic machine to the other and a gear 130, simultaneously operates the four advancement screws 15, 15*a* designed to move sliding blocks 122, carrying the screen roller 13, and to move the saddles 123 carrying the block-holding roller 12.

Each pair of feeding screws 15, 15*a* on the two shoulders of the machine is operatively connected to each other by means of a pair of gears 124 and is provided with locking elements 108.

The contact-detatching sequence is performed by a piston 109 which moves the sliding block 122 and thus the saddle 123.

Figure 11:
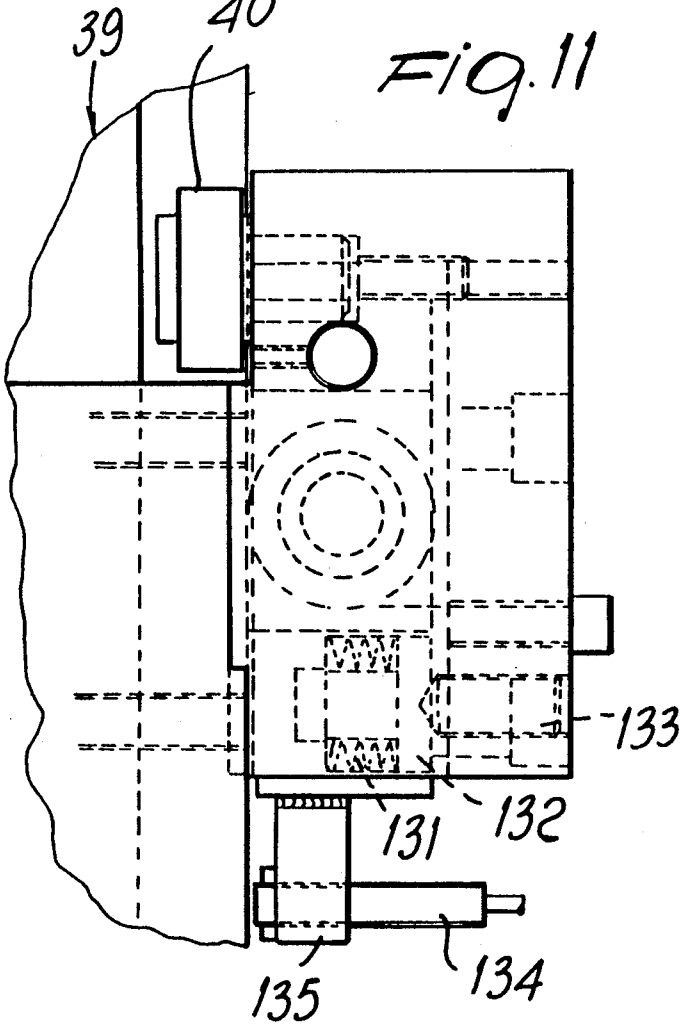
FIGS. 10 and 11 are two mutually perpendicular views of the trolley which can slide along the upright shown in FIGS. 2 and 3, illustrating a device for blocking the loading and unloading sequence of a block-holding roller.
Figure 10:
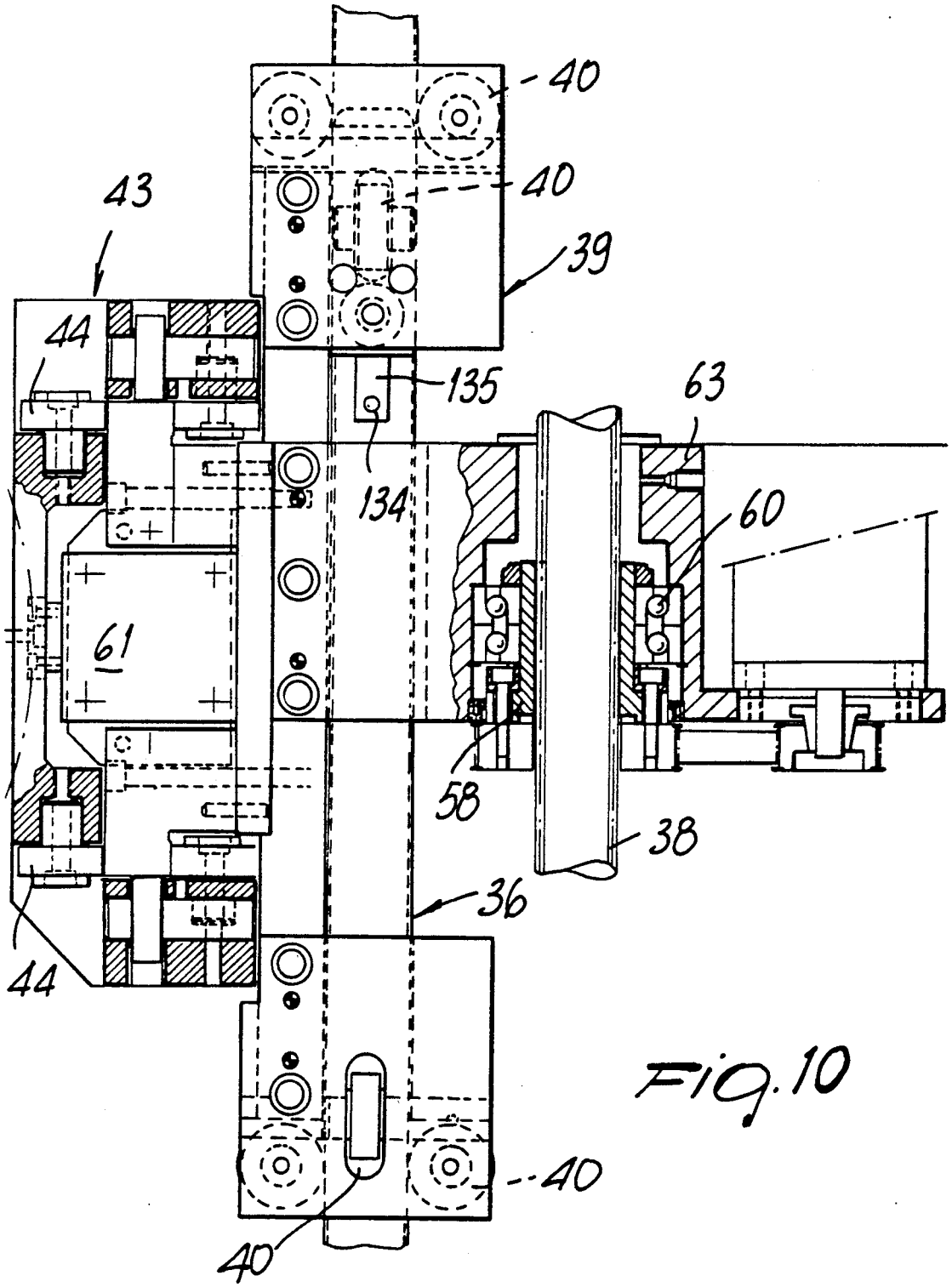

A device for locking the loading and unloading sequence of a block-holding roller in case of possible obstacles preventing it from being moved is illustrated in FIGS. 10 and 11, where the carriage 39, provided with wheels 40, has a disk-like spring 131 in its lower part, which urges a plate 132 coupled with a dowel 133.

A bracket 135 is welded below the carriage 39 and has a proximity detector 134 connected to a safety system (not shown).

Figure 12:
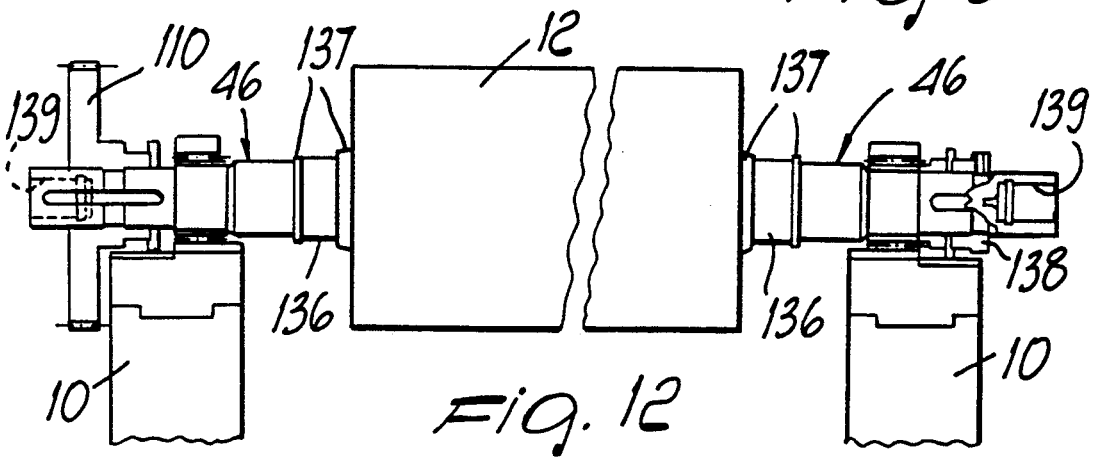
FIG. 12 is a front view of a block-holding roller supported at its ends by the lateral shoulders of a flexographic machine.

With reference to FIG. 12, the lateral shoulders 10 of a flexographic machine support a hold 46 of a block-holding roller which has a cylindrical portion 136 on both its sides. Adjacent to such a portion 136 there are two portions 137 having a greater diameter than said portion 136, so as to confine gripping means for said block-holding roller.

In the outermost part, the hold 46 has an outer ring 138 and a dead axial cavity 139 inside which the pivot 45 (not shown in FIG. 12) can be received.

The operation of the above described machine is as follows.

When the machine is at rest, the sliding block 122 and the saddle 123 of the actuation unit start being moved away until a maximum opened position is reached where the hydraulic caps 17 retaining the block-holding roller 12 are automatically opened so that the said roller can be removed.

While moving along the longitudinal guides 26, the loading and unloading device causes the upright 36 to rotate, the carriage 39 to slide along the upright and the sliding head 43 to move at right angle thereto, and moves near a block-holding roller to be replaced. The engagement pin 45 is then introduced in the end cavity 139 of the hold 46 of the block-holding roller and engages the roller only at one side thereof by means of the clamps 49.

The roller 12 is then raised and, following a preset path, is gradually removed from its seat. The grip clamps 49 have been previously inclined, e.g. by 30 degrees, so as to cause the roller to rest on one clamp only, which is safer in that the roller is prevented from falling in case of accidental opening of the clamps.

The sliding head or arm 43 then retracts in a direction parallel to the axis of the printing unit until it reaches a limit switch for the horizontal slider. The upright 36 then rotates about itself through 90 degrees, before moving on the carriage 28 in a direction normal to the axis of the drum 11 until it reaches the unloading position, where it further rotates on itself through 90 degrees.

The loading and unloading device then unloads the roller on the trolley 95 and is ready to start a new loading or unloading operation, a loading operation comprising a reverse sequence of steps.

Once a new roller 12 has been placed on the supports 91, presetting is performed by causing the roller 12 to rotate to a correct angular position, by means of the engagement pin 15, which can be rotated by a suitable electric motor (not illustrated). At the same time, a computerized system checks the position of the offset roller 11 so that it has an angular excursion precisely defined by the specific block mounted on the block-holding roller as described above.

At this point, once suitable detectors checked that exact positioning of the offset, block-holding and screen rollers has been achieved, the final coupling of the sliding blocks 122 to keep the rollers well urged one against the other, and the final printing positioning step are performed.

Then, by means of the actuation handwheels (or by means of program-controlled motors, not shown), in which indicators displaying the extent of the correction to be made are accommodated, the correct printing contact position between the block-holding roller 12 and the offset roller 11 is set.

Once the presetting step has been completed, the sliding head 43 of the automatic loading and unloading device retracts, the hydraulic caps 17 for retaining the block-holding roller are automatically closed, and the flexographic machine can start. Of course, the operation of the block-holding roller replacement can be effected at one, a few or all the printing units.

Figure 14:
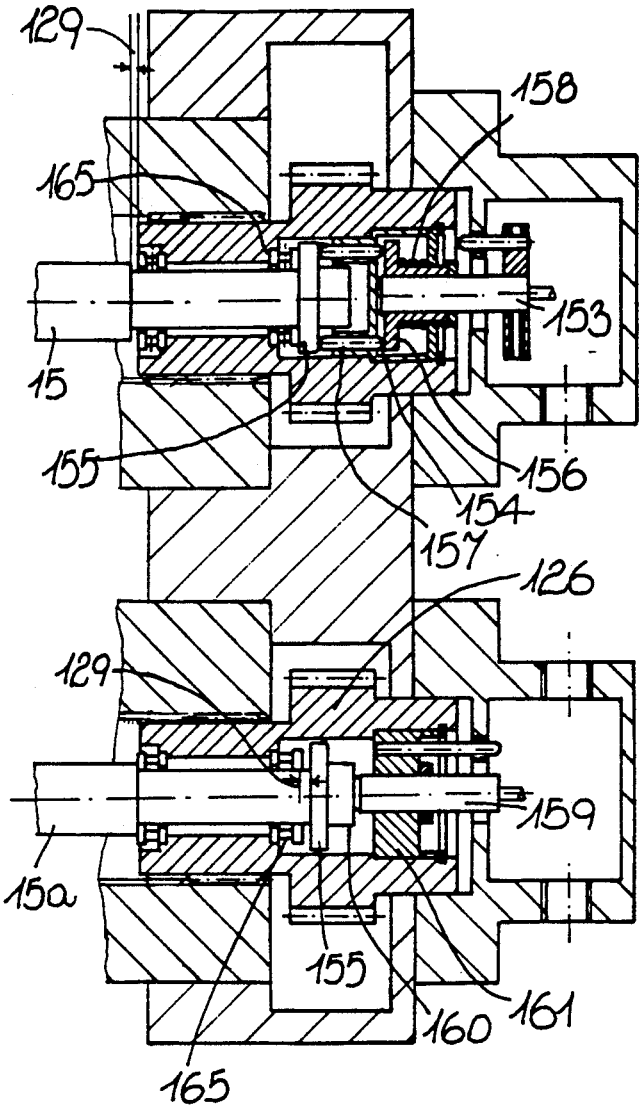
FIG. 14 shows a detail of FIG. 13 on an enlarged scale.
Figure 13:
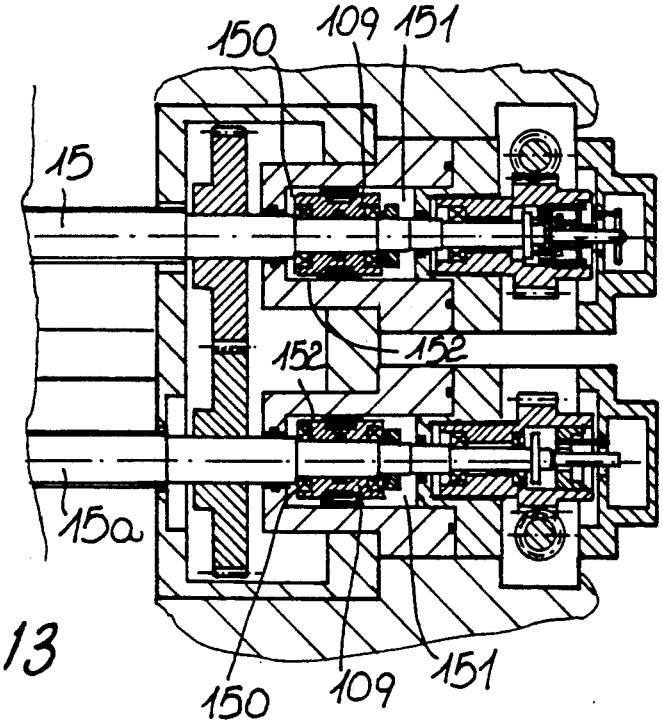
FIG. 13 shows a modification of FIG. 9.

FIGS. 13 and 14 show a modification of FIG. 9 where a pair of double-acting cylinder-piston units 109 are arranged to operate the feeding screws 15 and 15*a* owing to the pressure applied by a pressure medium supplied to the inner space 150 and 151 in each cylinder of the cylinder piston units, so as to move a respective block-holding roller 12 and screen cylinder 13 in contact with, or away from, the offset roller 11 for a distance 129. A proximity detector 153 is removably kept in abutting engagement with a cap 154 by a limit switch 155 for the feeding screw 15, the cap 154 touching a support 156 for the proximity detector 153 by means of pins 157.

Any backward and forward movement of the feeding screw 15 results in variations in the positioning of the detector 153 against or in agreement with the action of a spring 158 acting on the detector support 156.

At the rear end 160 of the feeding screw 15*a*, there is provided a proximity detector 159 secured to a support 161, which is rigid with the pinion 126, and arranged to be touched by the screw end 160. If the block-holding roller 12 and the screen cylinder 13 are in a position of maximum distance from the offset roller 11, hydraulic pressure is applied in the spaces 151, so that the pistons 109 operate the screws 15 and the limit switch 155 is moved into abutting engagement with a thrust block 165.

Should an obstacle interfere, thereby preventing the distance 129 from being covered, an overpressure is built up within the spaces 151 and a safety valve (not shown in the drawings), which is provided for each space 151 and is suitably set at a predetermined limit pressure, discharges a portion of fluid from its respective space 151, thereby allowing the screws 15 to move backwards, which results in the detectors 153 being moved away from their respective caps 154.

The same applies to the feeding screws 15*a*, except that the backward movement of the screw 15*a* results in the distance between the screw end 160 and the detector 159 being shortened. Thus, the proximity detector 159 is energized to control an alarm system, e.g. a relay of a control unit arranged to stop the flexographic machine.

The opposite situation occurs if the block-holding roller 12 and the screen cylinder 13 are initially in a position of minimum distance from the offset roller 11.

The above described device is susceptible to numerous modifications and variations within the scope of the appended claims.

As a matter of fact, the above described apparatus can be operated by one operator located at a control console to control the operations to be carried out by means of a computerized processing system.

I claim:

1. A multicolor flexographic machine with star-shaped structure, having two supporting shoulders, a printing drum or offset roller mounted for rotation on said shoulders, a plurality of inking stations arranged angularly spaced around said drum, each station comprising a block-holding roller adjacent to the offset roller and a screen cylinder which is arranged to transfer ink from a drawing roller or from a doctor blade to the block-holding roller and can be moved close to, or away from, the offset roller, wherein it comprises a device or robot for automatic and sequential loading and unloading of the block-holding rollers on and from the various inking stations, said device having a support saddle or carriage which is motor-driven along guides which extend parallel to one of said shoulders, an upright structure which extends from said support carriage and is mounted for rotation about a vertical axis, a retractable arm which projects from said upright structure, grip or clamping means supported by said arm and adapted to engage an end or hold of a block-holding roller to raise it in a cantilevered manner, actuating means on said upright structure which are adapted to cause said arm to retract or extend, and program control means for controlling said loading and unloading device.

2. A machine according to claim 1, wherein each inking station comprises two holding caps for each block-holding roller, each holding cap being designed to retain a respective hold of the block-holding roller so that it can rotate, actuation means arranged to automatically open and close said caps for the automatic replacement of the block-holding rollers.

3. A machine according to claim 2, wherein each holding cap is pivoted at one end about a pivot so that it can rotate between a closed position and an opened position to allow its respective block-holding roller to be set in position or removed.

4. A machine according to claim 1, wherein said grip or clamping means comprises a two-jaws clamp or pliers unit arranged removably to engage a base end of the hold of a block-holding roller, a projecting pin for supporting and actuating said clamp or pliers unit, actuation means for said clamp or pliers unit, and abutting means designed to engage the said hold of the block-holding roller.

5. A machine according to claim 4, wherein said clamp or pliers unit comprises actuation means arranged to incline the said clamp or pliers unit with respect to a vertical plane to ensure that the block-holding roller predominantly rests on a single jaw of the clamp or pliers unit.

6. A machine according to claim 4, wherein said abutting means comprises at least one pin for engaging a dead axial receiving end cavity provided in each hold of said block-holding rollers and at least one proximity detector adapted to detect coupling between said pin and said cavity to energize said clamp unit.

7. A machine according to claim 6, wherein said pin is mounted for rotation on said retractable arm and is operatively connected to actuation means.

8. A machine according to claim 1, wherein said automatic loading and unloading device comprises a longitudinal floor or ceiling-mounted base having guides in which a carriage is movable mounted, a geared motor and worm screw arrangement adapted to transmit the motion to said carriage, a center plate supported by said carriage and carrying said upright structure, and a geared motor adapted to rotate said center plate.

9. A machine according to claim 8, wherein said upright structure comprises a pivot pin on which said upright structure can rotate about a vertical axis, a saddle or carriage which is slidably mounted parallel to the axis of the rotation pivot pin and supports said retractable arm, and actuation means for the sliding movement of said saddle or carriage.

10. A machine according to claim 1, wherein said retractable arm comprises a head, horizontally sliding guides along which the said head can slide, clamping jaws carried at one end of said head and pivot means carried at the other end of the head and arranged to engage a hold of a block-holding roller, and a fluid-operated unit for the sliding movement of said head.

11. A machine according to claim 1, wherein it comprises a roller supporting trolley having coupling means for being removably blocked in a fixed reference position with respect to said upright structure.

12. A machine according to claim 1, wherein said program control means comprise a computer arranged to cause an angular excursion of a block-holding roller after the same has been located on an inking station, coupling pins adapted to lock each block-holding roller and the respective screen cylinder in a correct angular position, gears keyed on said block-holding roller and gears keyed on the respective screen cylinder, a device for converting the angular rotation of the offset roller and a device for measuring said angular rotation, thereby controlling said angular movements so as to locate the color block in each inking unit in accordance with angular values set by the program.

13. A machine according to claim 1, wherein it comprises a compensation device adapted to perform the final correction for printing by rotating micrometric feeding screws for adjusting the distance between a block-holding roller and its respective offset roller.

14. A machine according to claim 13, wherein it comprises a safety system including at least one fluid-operated cylinder-piston unit arranged to operate the said feeding screws to move for a relatively short distance a respective block-holding roller and screen cylinder in contact with, or away from, the offset roller, a safety valve adapted to discharge fluid from the fluid-operated cylinder-piston unit when the fluid pressure therein exceeds a predetermined limit pressure, and at least one proximity detector designed to detect the position of said feeding screws.

* * * * *